United States Patent [19]

Martin

[11] 4,347,487

[45] Aug. 31, 1982

[54] HIGH FREQUENCY ATTENUATION CABLE

[75] Inventor: Albert R. Martin, Oakland, Calif.

[73] Assignee: Raychem Corporation, Menlo Park, Calif.

[21] Appl. No.: 210,202

[22] Filed: Nov. 25, 1980

[51] Int. Cl.[3] ..... H01P 3/06

[52] U.S. Cl. ..... 333/1; 174/36; 333/12; 333/243

[58] Field of Search ..... 174/36, 106 SC; 333/12, 333/1, 236, 243, 245; 178/45, 46

[56] References Cited

U.S. PATENT DOCUMENTS 2,228,798 1/1941 Wassermann ..... 178/45

2,622,152 12/1952 Rosch ..... 333/243

3,541,473 11/1970 Schlicke et al. ..... 333/243 X 4,059,724 11/1977 Ide ..... 174/36

*Primary Examiner*—Paul L. Gensler

*Attorney, Agent, or Firm*—Douglas A. Chaikin; Herbert G. Burkard; James W. Peterson

[57] ABSTRACT

A high frequency attenuation cable which includes: a conductor; a high frequency absorption medium surrounding the conductor for attenuating high frequency energy through the cable; dielectric surrounding the absorption medium; electrical shielding surrounding the dielectric confining the high frequency energy to the absorption medium; and electrically conductive outer jacketing surrounding the shielding preventing the shielding from becoming a high frequency transmission line.

9 Claims, 4 Drawing Figures

HIGH FREQUENCY ATTENUATION CABLE

BACKGROUND OF THE INVENTION

Usage of inline filters and high frequency attenuation cables has sharply increased over the past few years, especially in military applications to prevent accidents where, for example, electromagnetic interference causes bomb bay doors to open and landing gear to engage without pilot command.

Various attempts have been made to solve these and other problems associated with electromagnetic interference by using high frequency attenuation cables. For instance, it has long been known in the art that wrapping a core conductor with a high frequency absorption medium such as lossy material causes the low frequency energy to pass through the cable unobstructed, while the high frequency energy is absorbed in the lossy layer. This is specifically set forth in F. Mayer's U.S. Pat. Nos. 3,309,633 and 3,191,132.

Many embodiments of a lossy high frequency attenuation cable have been previously disclosed by others. For instance in Murphy, U.S. Pat. No. 3,215,768 a conductor is wrapped by combinations of low and high permeability shields and then wrapped by an insulator. The same basic structure is set forth in Hirose, U.S. Pat. No. 3,683,309 wherein a textile filament supports a lossy layer, the lossy layer is wrapped by a conductive non-metallic filament and surrounded in turn by a second lossy layer, rubber insulation surrounds the second lossy layer, the elements recited above are then surrounded by a protective rubber coating. Also, Clark, U.S. Pat. No. 3,219,951 shows a similar structure wherein the external jacket is of a non-conducting or insulating material.

The art of high frequency attenuation cables has further been advanced through the development of particular lossy mediums. For instance, F. Mayer in U.S. Pat. No. 3,191,132 describes particular ferrite compounds for his lossy layers, in Fondiller, U.S. Pat. No. 1,672,979 the lossy layer includes finely divided particles of pure iron, see also F. Mayer, U.S. Pat. No. 3,309,633 where particular types of lossy layers are disclosed. Those portions of the above cited disclosures referring to particular lossy mediums are incorporated herein by reference.

In previously known high frequency attenuation cables the high frequency attenuation was often lower than desired. Applicant herein suggests that previously known high frequency attenuation cables may have suffered from having alternate paths by which the high frequency energy could travel from one end of the cable to the other without significant attenuation. These paths are referred to as sneak paths. Applicant provides additional conductive material on the outside of the cable which eliminates these sneak paths.

Others have suggested wrapping the lossy layer with an outer layer of conductive material. For instance, in F. Mayer, U.S. Pat. No. 4,104,600 which discloses a lossy core supported by an inside textile thread, the lossy core being wrapped by a conductor and a second lossy layer which includes dielectric material, the second lossy layer is designed to serve as both a dielectric and a high frequency energy absorber, and the above recited elements surrounded by a conductive outer sheet. Additionally, British Insulated Cables, Limited in British Pat. No. 565,228 (hereinafter BIC) discloses a textile core surrounded by a lossy layer which is in turn surrounded by a conductor, the lossy layer is in turn surrounded by a conductive rubber or ozone-resistant material, followed by a layer or layers of insulating material, which are in turn followed by a protective layer and a tubular metallic braid which may form the external covering of the cable or may be itself enclosed in a protective layer. Note BIC also suggests using a protective covering (assumed to be non-conductive around the above recited elements (p. 2, lines 75–77). Another example of additional conductive material in a high frequency attenuation cable is found in Schlicke et al, U.S. Pat. No. 3,541,473 (hereinafter Schlicke et al) which discloses a twin conductor power cable having one of the conductors as the outer most layer with lossy material and dielectric between the two conductors.

Applicant's structure differs from previous structures inasmuch as applicant provides a shielding layer and an outer conductive jacket around a core conductor surrounded by a high frequency absorbing medium and a dielectric. The shielding layer prevents electromagnetic interference and in combination with the outer conductive jacket, as will be appreciated more fully hereinafter, retains the high frequency energy in the lossy layer by blocking any alternate path which could develop if the outer conductive jacket were an insulator. In comparison to F. Mayer, U.S. Pat. No. 4,104,600, applicant provides a structure which both shields the cable against electromagnetic interferences (hereinafter EMI) at the same time retaining the high frequency energy in the lossy material. In comparison to BIC or Schlicke, et al, applicant provides a high frequency attenuation cable which does not allow the shielding found in the above cited references to act as a high frequency transmission line.

Typical of the commercial art of high frequency attenuation cables against the background of the above recited references in Capcon Inc.'s (147 West 25th St., New York, N.Y. 10001) lossy line filter cable which includes a conductor surrounded by a lossy medium which is in turn surrounded by dielectric and in turn surrounded by shielding braids and finally surrounded by an outer insulating jacket. Applicant has developed a commercial high frequency attenuation cable different from any high frequency attenuation cable heretofore which increases the amount of filtering heretofore known as well as ensuring the elements comprising the cable function properly.

SUMMARY OF THE INVENTION

Applicant has developed a high frequency attenuation cable which includes a conductor surrounded by a high frequency absorption medium for attenuating high frequency energy through a cable, a dielectric material surrounding the absorption medium, electrically conductive shielding means confining high frequency energy to the absorption medium, the electrical shielding surrounding the dielectric, and an electrically outer conductive jacketing means for preventing the shielding means from becoming a high frequency energy conductor, the jacketing surrounding the shielding.

Applicant's high frequency attenuation cable may comprise a multi-conductor type cable, wherein there are several central conductors surrounded by the same outer elements as described above. Also, applicant's cable may comprise a harness including a plurality of high frequency attenuation cables.

OBJECTS OF THE INVENTION

The primary object of this invention is to provide an electrically conductive cable capable of attenuating high frequencies and suppressing electromagnetic interference.

Another object of this invention is to provide a high frequency attenuation cable which may be used in conjunction with other cables in an application such as a wiring harness.

Another object of this invention is to block high frequency energy from bypassing the lossy material and coupling to the conductive shielding.

Another object of this invention is to provide a high frequency attenuation cable as recited above which resists mechanical damage.

DETAILED DESCRIPTION OF THE INVENTION

Figure 1:
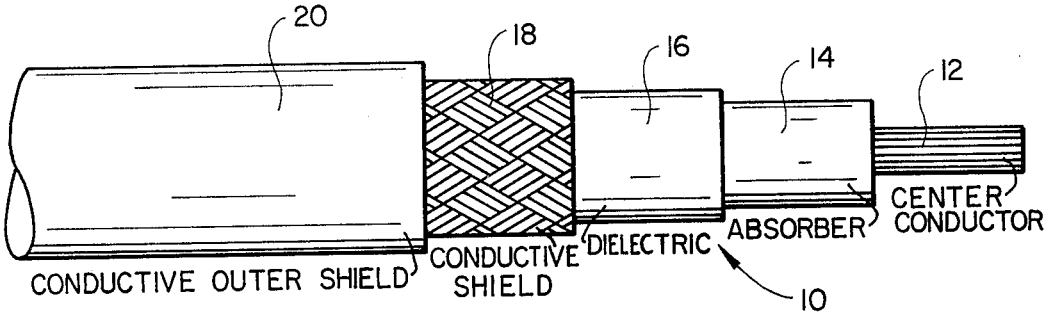
FIG. 1 is a partial cross sectional view of a high frequency attenuation cable in accordance with this invention.

With reference to the drawings wherein like reference characters designate like or corresponding parts throughout the several views and referring particularly to FIG. 1 there is shown a high frequency attenuation cable in accordance with this invention generally designated by the numeral 10.

The cable includes a central conductor 12, a high frequency energy absorbing medium 14 surrounding the conductor, a dielectric or insulation means 16 surrounding the high energy absorption medium 14, electrically conductive shielding means 18 surrounding the dielectric 16 and a conductive outer jacket 20 surrounding the conductive shielding 18.

Figure 2:
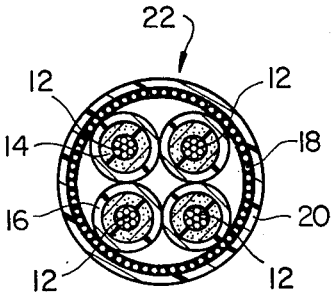
FIG. 2 is a full cross section of a multi-conductor high frequency attenuation cable in accordance with this invention.

The conductor 12 may be a single filament, a solid conductor or a group of filaments or similar structure. Additionally, the cable may be a multi-conductor cable, as indicated generally at 22, in FIG. 2 wherein there are a plurality of conductors 12 in each cable.

The high frequency energy absorbing medium 14 may be of any suitable material. It has been found that lossy material such as that described in F. Mayer's U.S. Pat. Nos. 3,309,633 and 3,191,132 are particularly useful in absorbing high frequency and applicant incorporates herein by reference those parts of F. Mayer's above referenced applications which refer to particular lossy or high frequency absorbing mediums.

More generally applicant has found that the absorption medium should be primarily of a high magnetic permeability and secondarily of a low chemical activity. High permeability material is desirable because it has generally been found by experimentation to have a high absolute loss which in turn means high absolute absorption, the desirable characteristic. As explained by VonHippel in *Dielectrics and Waves* at 5 (Technology Press of M.I.T. & Wiley 1954), the complex magnetic permeability can be written as $\mu^*=\mu'-j\mu''$, where $\mu'$ is the reactive part and $\mu''$ is the dissipation (or loss) part, and $j=\sqrt{-1}$. This equation can be rewritten as $\mu^*=\mu_o\mu_r(m'-jm')$ where $\mu_o=4\pi\times10^{-7}$ H/M (permeability of free space), $m'=\mu'/(\mu_o\mu_r)$ and $m''=\mu''/(\mu_o\mu_r)$, and $\mu_r$ is the permeability relative to free space. As $\mu_r$ is increased, both the reactive and the loss part of the magnetic permeability increase, hence greater absorption.

Low chemical activity is important to avoid degradation of the cable, thus preventing lowered performance of the cable due to aging or environmental effects such as corrosion and oxidation.

It has been found that by using a material such as a filled elastomer the high frequency energy is absorbed by the spin wave system, but low frequency energy passes unaffected. As the magnetic permeability increases, the absorption medium 14 becomes more effective at filtering the higher frequencies.

Dielectric 16 surrounds the absorption medium 14 aiding the conductor or conductors 12 to function more efficiently. Applicant recognizes that the absorption medium may be quite conductive and suggests that without dielectric 16 surrounding the absorption medium there may be insufficient resistance resulting in inefficient operation of the central conductor 12. This phenomenon is especially apparent in high voltage usage. The dielectric may be made of material such as Tefzel* which has been found by experimentation and analysis to be quite effective.

*Federally Registered Trademark of E. I. duPont de Nemours & Company

Applicant thereafter surrounds his dielectric 16 with electrically conductive shielding 18, the shielding provides a means for trapping and confining high frequencies to the absorption medium 14. Additionally, the shielding also prevents electromagnetic interference (radio frequency) from entering the cable.

As is good general practice in the art of manufacturing wire cables it is preferable to jacket shielding such as at 18 to prevent fraying or other mechanical or chemical damage. Additionally in the bundle or harness embodiment of the invention, flexibility is added to the harness because each jacket provides a smooth surface over which the individual cables may slide as they are flexed. Further, in all the embodiments flex life is increased because the jacket prevents fraying or other mechanical damage. In the past, as has been heretofore described, others have used an insulating material to wrap the electrically conductive shielding means to prevent such mechanical damage. Applicant however, has found that using such insulating material causes the cable and any neighboring conductors to act as an external transmission line wherein the high frequency energy from the absorption medium 14 couples with the shielding 18 and/or neighboring conductors, thereby defeating the purpose of the absorption medium 14.

By surrounding an electrically conductive jacket 20 around the shield 18, applicant provides a means for protecting the shield from mechanical damage and adding flex life to the cable while at the same time preventing the shielding 18 from becoming a high frequency transmission line. Applicant has found that a filled elastomer such as Viton* successfully accomplishes the objects and purposes of the invention because Viton* can be loaded with absorptive material, while retaining elastic and high temperature properties.

*Federally Registered Trademark of E. I. duPont de Nemours & Company

Figure 3:
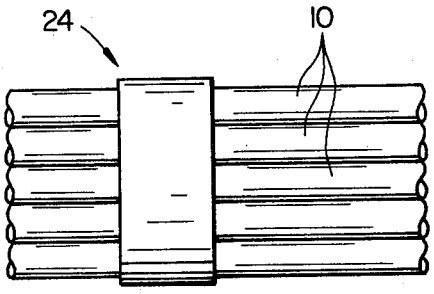
FIG. 3 is a partial cross sectional view of a high frequency attenuation harness in accordance with this invention.

With particular reference to FIG. 3 there is seen the cables in a bundle or harness 24. Particular applications including some military applications require that applicants cable be in this harness form. In this form particular electrical problems result, including the development of sneak paths. It has been found that when a number of high frequency attenuation cables are wrapped in a bundle or harness the high frequency energy escapes the absorption medium and travels around and about the cables in a phenomenon known as sneak paths. It has been found that when the outer layer is conductive it shorts out against a neighboring cable, thus blocking the transmission of high frequencies. In this embodiment, applicant provides either a cable which includes a naked outer conductive shielding 18, or a cable which includes the shielding 18 surrounded by a conductive jacket such as at 20. In either embodiment the outer conductive layer blocks the transmission of high frequency energy by shorting out against its neighbor, thus eliminating the sneak paths. Even in a single cable situation where the cable is exposed to a conductive surface, for example a cable inside a helicopter frame, the high frequencies may move out of the absorption medium and couple with the helicopter frame thereby creating a sneak path and cancelling the effectiveness of the absorptive medium.

It has been found that the outer conductive jacket should be of a material having a high magnetic saturation point and a low resistivity to maintain desirable attenuation characteristics even when the cable is subjected to heavy electrical current. The outer conductive jacket should be of material such as a filled polymer having carbon black or elastomers with carbon black, or ferrite loaded polymers or elastomers.

Figure 4:
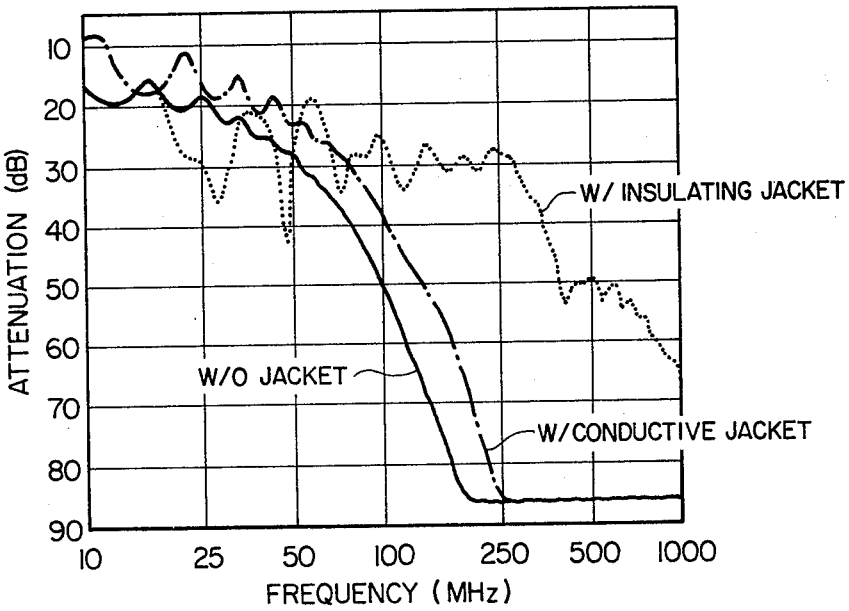
FIG. 4 is a graphic illustration of the high frequency attenuation characteristics of three cables, one having an outer conductive jacket, a second having no jacket and a third having an insulated outer jacket.

With particular reference to FIG. 4 there is seen a graphic comparison of the high frequency attenuation characteristics of three cables, one having an outer conductive jacket, a second having no jacket and a third having an insulated outer jacket.

As can be seen generally as the frequency increases the attenuation also increases for each of the cables. However, as can be seen at 100 MHz, the cable without a jacket has the greatest attenuation 50 db, the cable with the conductive jacket at 38 db and the cable with an insulating jacket has an attenuation of 26 db. As the frequency increases, particularly at 250 MHz, the outer conductive jacket sample and the sample without a jacket have the same attenuation (about 86 db) while the insulating jacket sample has an attenuation of approximately 27 db. As the frequency is increased, past 250 MHz, the sample having an outer conductive jacket and the sample without a jacket falls below the background level of the measuring apparatus. At this point the attenuation level is too high to measure for the present measuring apparatus. However, applicant presumes a continued smooth downward line as the frequency increases.

It is significant to note that the typical frequencies at which the cable is used are 100 to 18,000 MHz.

While the instant invention has been described by reference to what is believed to be the most practical embodiments, it is understood that the invention may embody other specific forms not departing from the spirit of the central characteristics of the invention. It should be understood that there are other embodiments which possess the qualities and characteristics which would generally function in the same manner and should be considered within the scope of this invention. The present embodiments therefore should be considered in all respects as illustrative and not restrictive, the scope of the invention being limited solely to the appended claims rather than the foregoing description and all equivalents thereto being intended to be embraced therein.

What is claimed:

1. A high frequency attenuation cable comprising:
a conductor;
a high frequency absorption medium for attenuating high frequency energy through the cable, the absorption medium surrounding the conductor;
dielectric surrounding the absorption medium;
electrically conductive shielding means confining high frequency energy to the absorption medium, the shielding means surrounding the dielectric; and
electrically conductive outer jacketing means preventing the shielding means from becoming a high frequency transmission line, the jacketing means surrounding the shielding means.

2. The cable as set forth in claim 1 wherein the outer jacketing means is made from a material having a high magnetic saturation.

3. The device as set forth in claim 2 wherein the outer jacketing means is made from a carbon filled elastomer.

4. The device as set forth in claim 2 wherein the outer jacketing means is made from a ferrite filled elastomer.

5. The device as set forth in claim 1 or claim 2 wherein the high frequency absorption medium comprises a lossy material of high magnetic permeability.

6. The device as set forth in claim 5 wherein the high frequency absorption medium comprises a material of low chemical activity.

7. The device as set forth in claim 5 wherein the high frequency absorption medium comprises a lossy layer of finely divided pure iron particles in a filled elastomer.

8. The device as set forth in claim 5 wherein the dielectric comprises material made of Tefzel.

9. A high frequency attenuation harness comprising:
a plurality of high frequency attenuation cables wherein each cable comprises:
a conductor;
a high frequency absorption medium for attenuating high frequency energy through the cable, the absorption medium surrounding the conductor;
dielectric surrounding the absorption medium;
electrically conductive shielding means confining high frequency energy to the absorption medium, the shielding means surrounding the dielectric;
each cable being provided with an electrically conductive outer jacketing means preventing the shielding means from becoming a high frequency electrical energy conductor, the jacketing means surrounding the shielding means.

* * * * *